US008482411B1

(12) United States Patent
Brown

(10) Patent No.: US 8,482,411 B1
(45) Date of Patent: Jul. 9, 2013

(54) TAMPER INDICATING PADLOCK ASSEMBLY

(76) Inventor: Monty M. Brown, Portland, OR (US)

( * ) Notice: Subject to any disclaimer, the term of this patent is extended or adjusted under 35 U.S.C. 154(b) by 445 days.

(21) Appl. No.: 12/759,810

(22) Filed: Apr. 14, 2010

(51) Int. Cl.
*E05B 45/06* (2006.01)

(52) U.S. Cl.
USPC ..... 340/542; 340/568.1; 340/543; 340/572.1; 340/539.31; 70/20; 70/256

(58) Field of Classification Search
USPC ..... 340/568.1–568.4, 542, 543, 571, 340/539.1, 339.11; 70/20–56, 57.1, 77
See application file for complete search history.

(56) References Cited

U.S. PATENT DOCUMENTS

| | | | | |
|---|---|---|---|---|
| 3,879,721 | A | 4/1975 | Yereance | |
| 5,194,845 | A | 3/1993 | Sirmon et al. | |
| D364,551 | S | 11/1995 | Christenson et al. | |
| 5,587,702 | A | 12/1996 | Chadfield | |
| 5,727,405 | A * | 3/1998 | Cromwell | 70/38 B |
| 5,755,576 | A * | 5/1998 | Dunn et al. | 434/258 |
| 5,836,002 | A * | 11/1998 | Morstein et al. | 340/568.1 |
| 6,043,733 | A | 3/2000 | Lind | |
| 6,420,971 | B1 * | 7/2002 | Leck et al. | 340/542 |
| 6,950,033 | B1 * | 9/2005 | Guyre | 340/687 |
| 7,323,967 | B2 | 1/2008 | Booth et al. | |
| 7,363,782 | B1 | 4/2008 | Misner et al. | |
| 8,122,496 | B2 * | 2/2012 | Achari et al. | 726/17 |
| 2003/0227384 | A1 * | 12/2003 | Sweeney et al. | 340/540 |
| 2006/0288744 | A1 | 12/2006 | Smith | |
| 2008/0042866 | A1 * | 2/2008 | Morse et al. | 340/691.1 |
| 2009/0040874 | A1 * | 2/2009 | Rooney et al. | 368/10 |
| 2009/0167526 | A1 * | 7/2009 | Graves et al. | 340/540 |
| 2009/0243791 | A1 * | 10/2009 | Partin et al. | 340/5.2 |
| 2010/0007486 | A1 * | 1/2010 | Lu | 340/539.15 |
| 2010/0076705 | A1 * | 3/2010 | Liu et al. | 702/63 |
| 2011/0050419 | A1 * | 3/2011 | Ng et al. | 340/542 |

* cited by examiner

*Primary Examiner* — Benjamin C Lee
*Assistant Examiner* — Rajsheed Black-Childress

(57) ABSTRACT

A tamper indicating padlock assembly for providing remote indication of tampering with the lock mechanism of the padlock includes a padlock having a padlock housing, an arm extending from the padlock housing, and a locking mechanism selectively engaging the arm. A sensor is positioned in the padlock housing for sensing movement of the arm within the padlock housing. The sensor is operationally coupled to a processor. A transmitter is operationally coupled to the processor for transmitting a tamper signal upon the sensor detecting movement of the arm relative to the housing. A key is provided to release the arm from the locking mechanism. A remote alarm assembly has a remote receiver for receiving the tamper signal. The remote alarm assembly includes a remote tamper indicator operationally coupled to the remote receiver for providing an indication of tampering to a user when the remote receiver receives the tamper signal.

1 Claim, 4 Drawing Sheets

TAMPER INDICATING PADLOCK ASSEMBLY

BACKGROUND OF THE DISCLOSURE

Field of the Disclosure

The disclosure relates to padlocks and more particularly pertains to a new padlock for providing remote indication of tampering with the lock mechanism of the padlock.

SUMMARY OF THE DISCLOSURE

An embodiment of the disclosure meets the needs presented above by generally comprising a padlock having a padlock housing, an arm extending from the padlock housing, and a locking mechanism positioned in the padlock housing and selectively engaging the arm. A processor is positioned in the padlock housing. A sensor is positioned in the padlock housing for sensing movement of the arm within the padlock housing. The sensor is operationally coupled to the processor. A transmitter is positioned in the housing. The transmitter is operationally coupled to the processor for transmitting a tamper signal upon the sensor detecting movement of the arm relative to the housing. A key is provided for manipulating the locking mechanism to release the arm from the locking mechanism. A remote alarm assembly has a remote receiver for receiving the tamper signal. The remote alarm assembly includes a remote tamper indicator operationally coupled to the remote receiver for providing an indication of tampering to a user when the remote receiver receives the tamper signal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
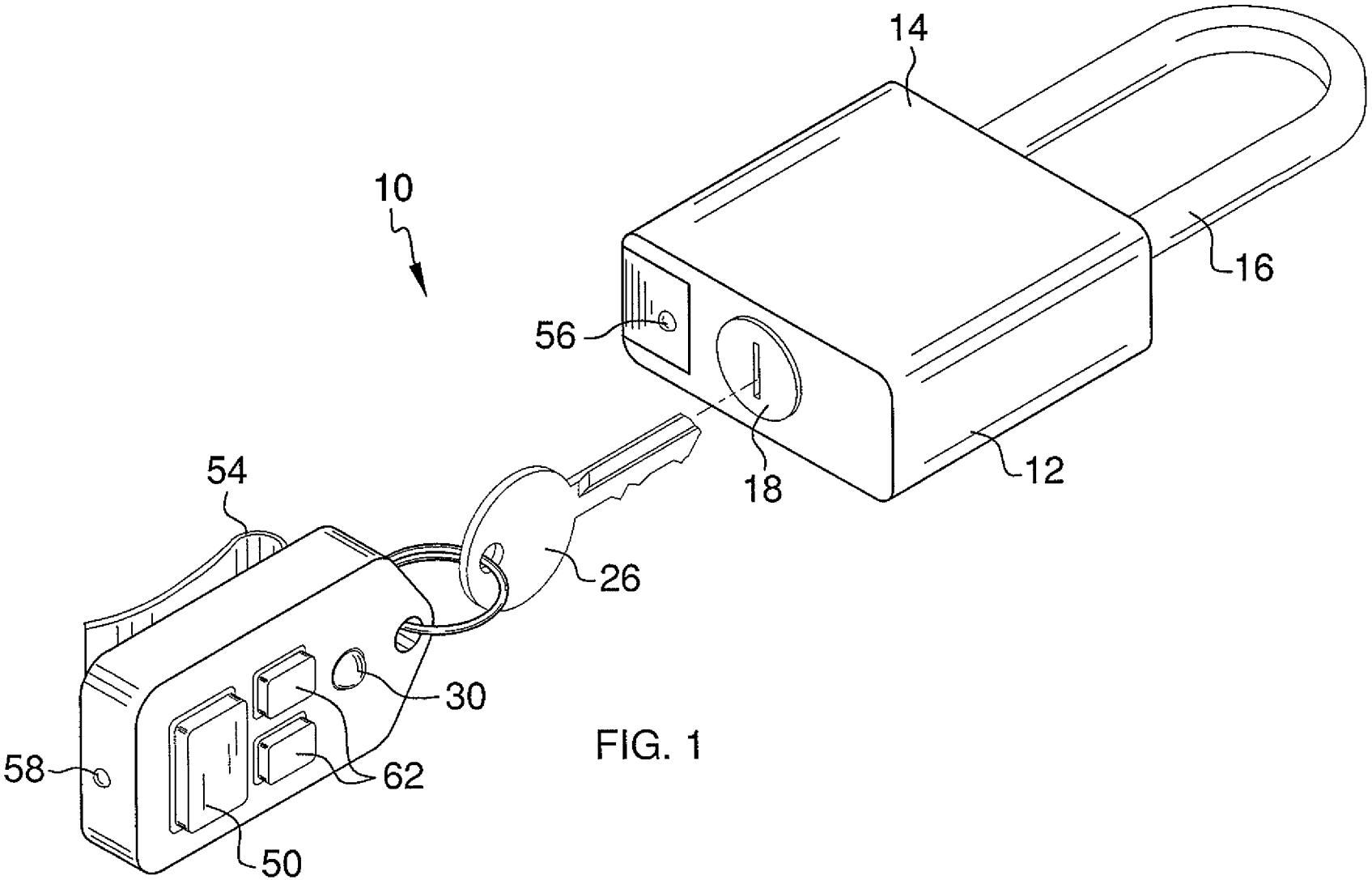
FIG. 1 is a bottom front side view of a tamper indicating padlock assembly according to an embodiment of the disclosure.
Figure 2:
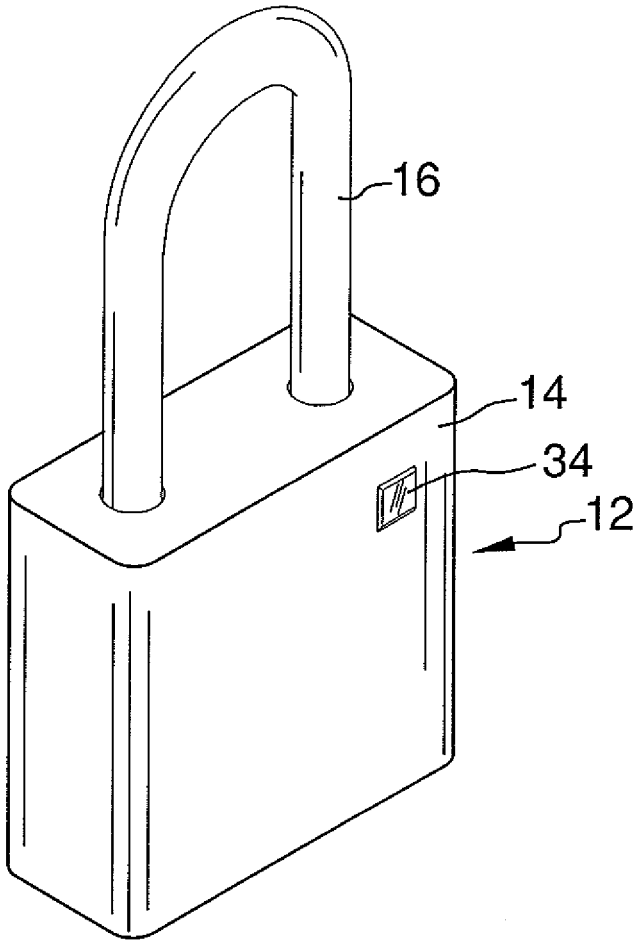
FIG. 2 is a top front side view of a padlock of an embodiment of the disclosure.
Figure 3:
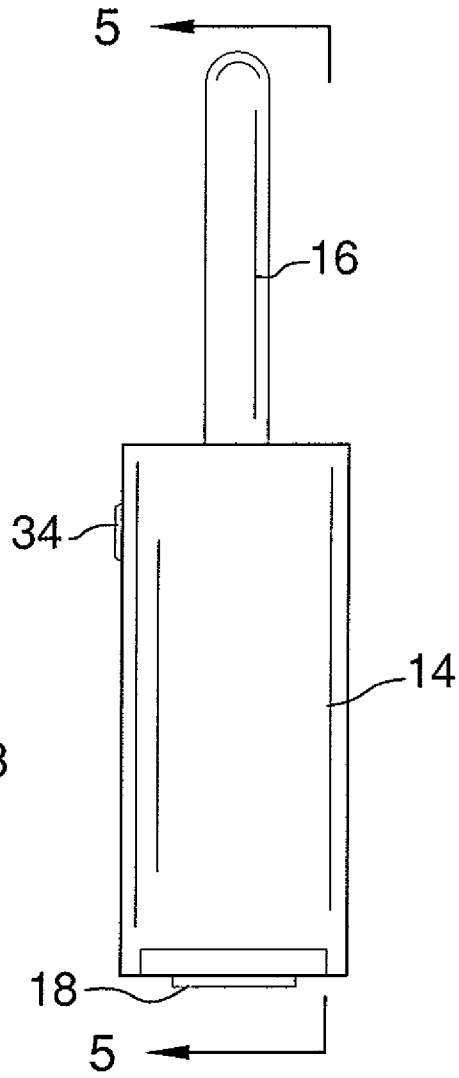
FIG. 3 is a side view of a padlock of an embodiment of the disclosure.
Figure 4:
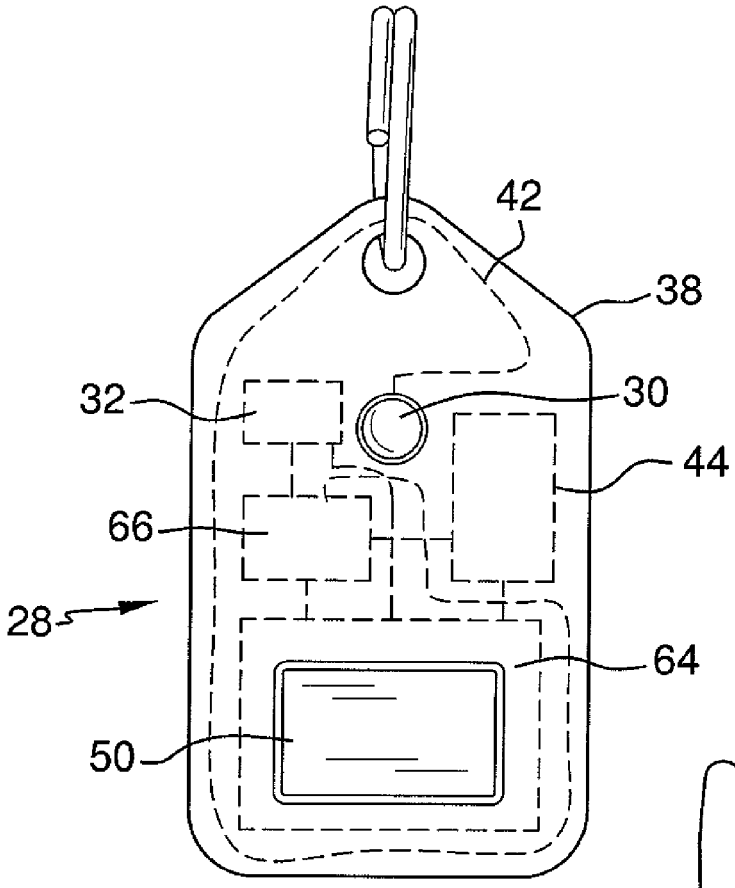
FIG. 4 is a front view of a key fob remote of an embodiment of the disclosure.
Figure 6:
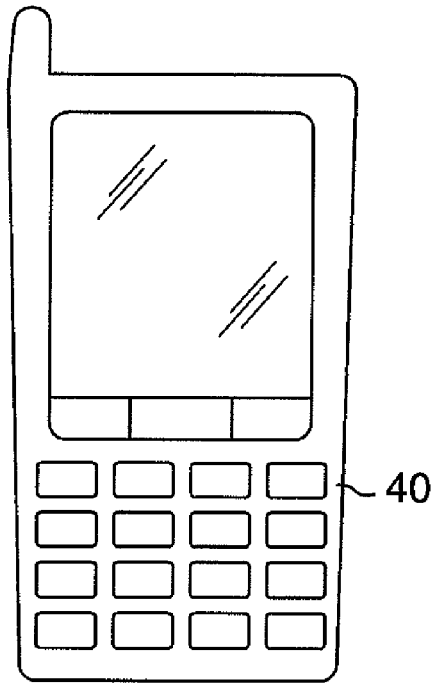
FIG. 6 is a front view of a cellular phone remote of an embodiment of the disclosure.
Figure 5:
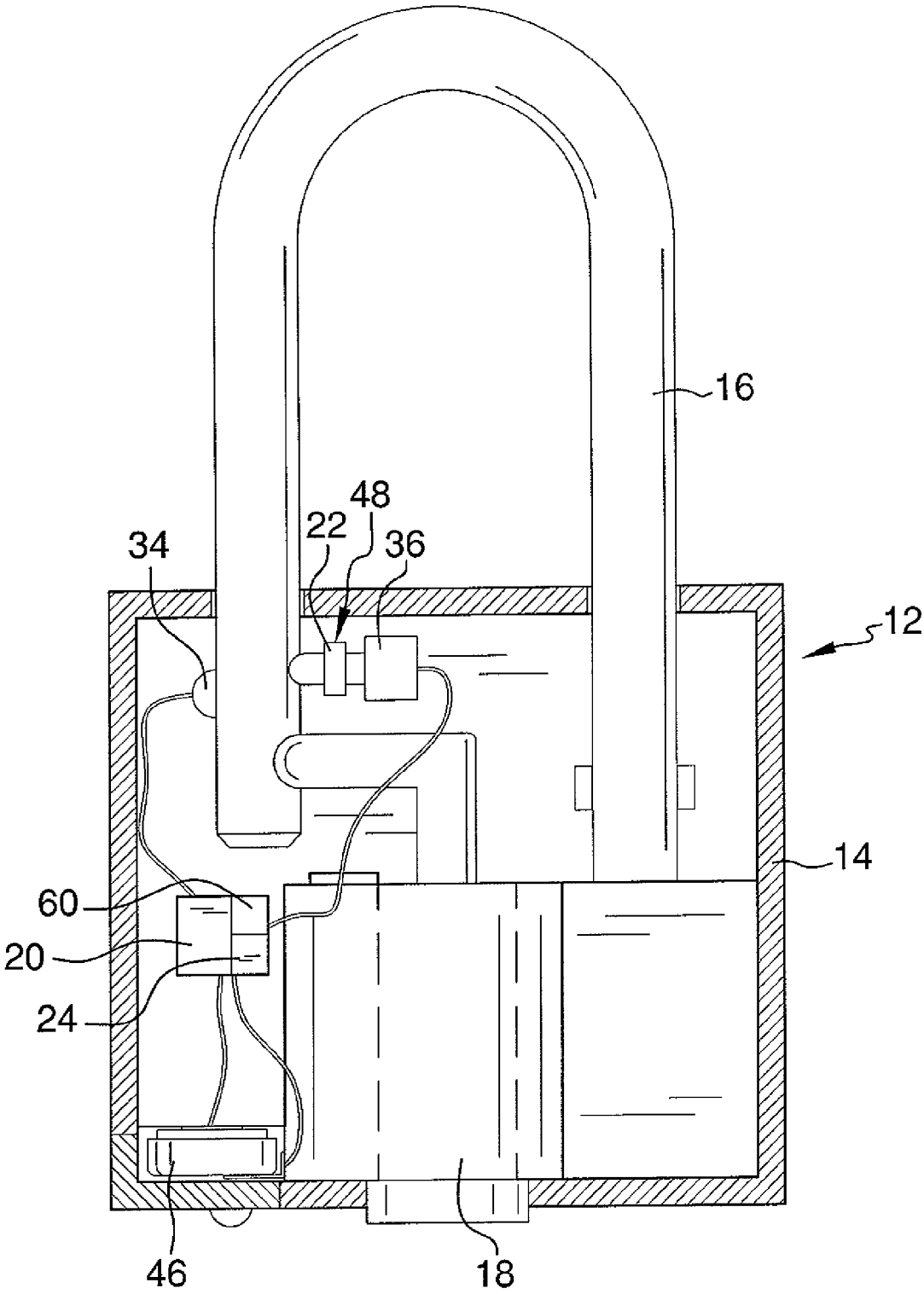
FIG. 5 is a cross-sectional view of a padlock of an embodiment of the disclosure taken along line 5-5 in FIG. 3.

With reference now to the drawings, and in particular to FIGS. 1 through 6 thereof, a new padlock embodying the principles and concepts of an embodiment of the disclosure and generally designated by the reference numeral 10 will be described.

As best illustrated in FIGS. 1 through 6, the tamper indicating padlock assembly 10 generally comprises a padlock 12 having a padlock housing 14, an arm 16 extending from the padlock housing 14, and a locking mechanism 18 positioned in the padlock housing 14 and selectively engaging the arm 16. A processor 20 is positioned in the padlock housing 14. A sensor 22 is positioned in the padlock housing 14 for sensing movement of the arm 16 within the padlock housing 14. The sensor 22 is operationally coupled to the processor 20. A transmitter 24 is positioned in the housing 14. The transmitter 24 is operationally coupled to the processor 20 for transmitting a tamper signal upon the sensor 22 detecting movement of the arm 16 relative to the housing 14. A key 26 is provided for manipulating the locking mechanism 18 to release the arm 16 from the locking mechanism 18. A remote alarm assembly 28 has a remote receiver 32 for receiving the tamper signal.

The remote alarm assembly 28 includes a remote tamper indicator 30 operationally coupled to the remote receiver 32 for providing an indication of tampering to a user when the remote receiver 32 receives the tamper signal. An alarm indicator light 34 is coupled to the processor 20 for illuminating the alarm indicator light 34 upon the locking mechanism 18 being manipulated into a locked position. The sensor 22 is activated by the processor 20 only when the locking mechanism is in a locked position.

A timer 36 is coupled to the processor 20 for delaying transmission of the tamper signal until the sensor 22 detects movement of the arm 16 in excess of a pre-determined length of time. The timer 36 is adjustable to permit a user to set a desired delay time or for turning off the timer 36 completely. The timer 36 is also operationally coupled to the processor 20 and a base receiver 60 such that the timer 36 may be set as desired remotely using a key fob 38 or a cellular phone 40. Timer adjustment buttons 62 are operationally coupled to a remote transmitter 64 provided in the key fob 38.

The remote alarm assembly 28 may be positioned in the key fob 38 or incorporated into the cellular phone 40. The key fob 38 having the remote alarm assembly 28 includes an antenna 42 coupled to the remote receiver 32. The remote alarm assembly 28 includes a vibrator 44 operationally coupled to the remote receiver 32 for vibrating the remote alarm assembly 28 upon the remote receiver 32 receiving the tamper signal. A belt clip 54 is coupled to the key fob 38.

A sensor assembly battery 46 is electrically coupled to the processor 20 for providing power to the processor 20. The sensor 22 is preferably a two-way open circuit trip sensor 48 for detecting movement of the arm 16 in opposing directions into and out of the housing 14.

The remote alarm assembly 28 includes a remote battery 66, a power button 50, and a remote activation light 52. The power button 50 is operationally coupled to the remote battery 66 and the remote receiver 32 for selectively activating the remote receiver 32. The remote activation light 52 is operationally coupled to the power button 50 such that the remote activation light 52 illuminates when the remote receiver 32 is activated.

A sensor assembly low battery indicator 56 is operationally coupled to the sensor assembly battery 46. Similarly, a remote assembly low battery indicator 58 is operationally coupled to the remote battery 66.

In use, the arm 16 of the padlock 12 is inserted through a locker or chain links and compressed into the padlock housing 14 to engage the locking mechanism 18. The alarm indicator light 34 illuminates to show the system is armed. The sensor 22 is powered by the sensor assembly battery 46 and detects movement of the arm 16 relative to the housing 14. Upon detection of sustained movement in excess of a pre-determined time period, a tamper signal is transmitted by the transmitter 24. The receiver 32 of the remote alarm assembly 28 receives the tamper signal and the tamper indicator 30 provides an indication to the user that the padlock 12 is being tampered with. The timer 36 may also indicate a period of inactivity after which the system is reset.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A tamper indicating padlock assembly comprising:

a padlock having a padlock housing, an arm extending from said padlock housing, a locking mechanism positioned in said padlock housing and selectively engaging said arm;

a processor positioned in said padlock housing;

a sensor positioned in said padlock housing for sensing movement of said arm within said padlock housing, said sensor being operationally coupled to said processor;

a transmitter positioned in said housing, said transmitter being operationally coupled to said processor for transmitting a tamper signal upon said sensor detecting movement of said arm relative to said housing;

a key for manipulating said locking mechanism to release said arm from said locking mechanism;

a remote alarm assembly having a remote receiver for receiving said tamper signal;

said remote alarm assembly including a remote tamper indicator operationally coupled to said remote receiver for providing an indication of tampering to a user when said remote receiver receives said tamper signal;

an alarm indicator light coupled to said processor for illuminating said alarm indicator light upon said locking mechanism being manipulated into a locked position;

wherein said sensor is activated by said processor only when said locking mechanism is in a locked position;

a timer coupled to said processor for delaying transmission of said tamper signal until said sensor detects movement of said arm in excess of a pre-determined length of time;

wherein said timer is adjustable to set a desired delay time;

wherein said remote alarm assembly is positioned in a key fob;

wherein said remote alarm assembly includes an antenna coupled to said remote receiver;

wherein said remote alarm assembly includes a vibrator operationally coupled to said remote receiver for vibrating said remote alarm assembly upon said remote receiver receiving said tamper signal;

a sensor assembly battery electrically coupled to said processor for providing power to said processor;

wherein said sensor is a two-way open circuit trip sensor for detecting movement of said arm in opposing directions into and out of said housing;

wherein said remote alarm assembly includes a remote battery, a power button, and a remote activation light;

wherein said power button is operationally coupled to said remote battery and said remote receiver for selectively activating said remote receiver;

wherein said remote activation light is operationally coupled to said power button such that said remote activation light illuminates when said remote receiver is activated;

a belt clip coupled to said key fob;

a sensor assembly low battery indicator operationally coupled to said sensor assembly battery; and a remote assembly low battery indicator operationally coupled to said remote battery.

* * * * *